United States Patent [19]

Landis et al.

[11] 3,988,192

[45] Oct. 26, 1976

[54] METHOD FOR TABLING DRAPERIES AND APPARATUS THEREFOR

[76] Inventors: Merrill Young Landis, 137 Third St., Telford, Pa. 18969; Otto Lloy Hilgner, 1340 Fairground Road, Hatfield, Pa. 19440

[22] Filed: June 6, 1975

[21] Appl. No.: 584,605

[52] U.S. Cl. ..... 156/267; 156/299; 156/322; 156/499; 156/522; 156/583

[51] Int. Cl.[2] ..... B32B 31/18

[58] Field of Search ..... 156/267, 295, 289, 299,- 156/322, 499, 516, 522, 530, 556, 574, 583, 582, 467, 289

[56] References Cited

UNITED STATES PATENTS

| | | | |
|---|---|---|---|
| 2,767,041 | 10/1956 | Gegner et al. | 156/299 |
| 3,540,975 | 11/1970 | Wright et al. | 156/295 |
| 3,575,760 | 4/1971 | Goldstein et al. | 156/295 |
| 3,733,237 | 5/1973 | Wolff | 156/107 |
| 3,795,565 | 3/1974 | Soto | 156/530 |
| 3,875,368 | 4/1975 | Biewald | 156/499 |

*Primary Examiner*—William A. Powell
*Assistant Examiner*—Jerome W. Massie
*Attorney, Agent, or Firm*—Joseph W. Molasky

[57] ABSTRACT

A method and apparatus for joining crinoline to drapery material to provide a stiffening for pleats.

The method consists of laying the drapery material face down on a table where it is secured by clamping devices at opposite ends so as to maintain the material in a stationary position.

The joining apparatus is activated to move across the edge of the drapery material which is to undergo the crinoline-bonding step. A feed roll dispenses a crinoline strip and, simultaneously, a second feed roll dispenses an adhesive filament which is interfed between the said crinoline and said drapery material. A preheater directs warm air over the crinoline immediately prior to its emplacement upon the material, whereupon, a heat wheel follows to apply heat and pressure to the combined layers of material, tape and crinoline so as to liquify the adhesive and cause it to spread so that it joins the crinoline and the material in a permanent bond.

Also, in addition to preheating the crinoline, the material is preheated to afford a more rapid and effective seal.

A cutter and cutter guide follow the heat wheel in a slotted track whereupon the excess of joined material and crinoline are cut off to provide a proper finish.

11 Claims, 5 Drawing Figures

METHOD FOR TABLING DRAPERIES AND APPARATUS THEREFOR

This invention relates to an apparatus for tableing draperies and to a method of using same.

Specifically, this invention relates to an apparatus which holds drapery material in a fixed and flat position where it is measured for height and subjected to a crinoline-bonding step to provide a stiffening for pleats. Thereafter, the excess of fabric is cut off and the crinoline-backed end of the material is folded over to provide a proper finish.

In principle, the crinoline-bonding is effected by inter-feeding a solid adhesive between the drapery material and the crinoline followed by the application of heat and a compressive force of such magnitude as to cause the adhesive to liquify and flow so as to effect a permanent seal between the material and the crinoline.

One aspect of this invention resides in the use of a preheating device to warm the crinoline prior to its contact with the adhesive.

A further aspect provides for preheating that edge of the drapery material which is subjected to the crinoline-bonding step.

Another aspect of this invention resides in the use of a heat-wheel to effect the bonding of the drapery material to the crinoline.

Another feature of this invention provides for carrying out the bonding step on a Teflon-backed tape.

Still another feature provides for maintaining the drapery material in a stationary and flat position while the machine which effects the bonding of the drapery material to the crinoline moves across the face of the crinoline to perform the bonding operation.

Further aspects of this invention will be apparent from the following description of the apparatus and its use.

BACKGROUND

It is known in the art to bond one fabric to another by interfeeding a solid adhesive therebetween followed by the application of heat.

U.S. Pat. No. 3,607,554 issued to W. R. Heffernan illustrates one such bonding method and an apparatus therefor. In the Heffernan method two layers of sheet material are joined along a narrow two-dimensional contour by laying a thermally active adhesive between the two layers and applying heat so as to cause the adhesive to liquify. The essence of that invention lies in the use of a pivot means which applies constant pressure to the fabric along a narrow contour or path so as to effect a bonding of the two layers along that contour.

According to Heffernan the adhesive is made to liquify by passing the layers of fabric and adhesive between an upper electrode and a lower electrode which are activated by a radio frequency field. The resulting field and the compressive force of the two electrodes causes the melted adhesive to flow and results in a bonding of the two layers.

The Heffernan operation is a suitable one for joining fabrics which can be conveyed by a moving belt but drapery material which can measure up to 50 feet or more in height, does not fall into the category.

Furthermore, the compressive force on the material to be joined in the Heffernan process includes pressure exerted by a pivot pin on the upper surface of said material. This pivot pin is in constant contact with the material and thus applies constant pressure. Consequently, when the pressure from the electrodes is released the continuing pressure from the pivot pin will still allow the operator to control the material by pivoting it about the pin. As a result, the materials can be joined along a narrow two-dimensional contour equivalent to the width of said pivot pin.

Again, drapery material is of such size and bulk that, as a practical matter, it cannot be pivoted during the bonding operation. Furthermore, the Heffernan method of joining fabrics along a narrow contour makes it unsuitable for tableing draperies because the area thus joined would not be of sufficient size as to provide a suitably pleatable area.

The narrow contour envisioned by Heffernan is an extremely narrow strip of joined fabric. By contrast, the crinoline-backed area on draperies is generally in the range of from about 3 to 5 inches in width. A crinoline backing of lesser dimension would simply fail to provide the area needed to create a shirred or pleated effect.

Another method for bonding fabrics via the use of an adhesive is described in U.S. Pat. No. 3,738,897 to G. Bianchini. In this method an interlining is secured between two fabrics by interfeeding an adhesive tape and subjecting the several layers to heat, pressure and cooling.

According to Bianchini the fabrics to be joined are placed on a conveyer belt with the adhesive therebetween and this multilayered sheet is transported to an area where heat is applied to the top and bottom surfaces thereof; to the top side thereof from an infrared source and to the bottom side thereof from a heat box. The coupled fabrics are then driven between pairs of pressure rollers and subjected to a flow of cool air which is blown across the face of the fabric to prevent calendering.

Obviously, the Bianchini process does not lend itself to the manufacture of draperies. In Bianchini the materials are conveyed along a moving belt and, obviously, it is impractical to move large areas of drapery material across a conveyor means when only one edge thereof is to be subjected to the bonding step.

Furthermore, the Bianchini method is expensive and inefficient. The heat which is blown across the tape for melting purposes is open to the atmosphere and, as a result, the heat is easily dissipated and thus results in an unnecessary expenditure of energy. Also, because Bianchini uses roller pairs to provide the compressive force for the bonding step, there is a tendency for the joined materials to undergo a calendering effect due to their being inclined over pressure rollers. To alleviate this effect Bianchini blows cool air over the joined material immediately after its exit from the pressure rollers. However, such an operation introduces still another step to the bonding process and adds appreciably to the overall cost of production.

SUMMARY OF THE INVENTION

This invention relates to a method and apparatus for bonding crinoline to drapery material to provide a stiffening for pleats.

The novel method consists essentially of laying the drapery material face down on a support where it is secured by clamping devices at opposite ends so as to maintain the material in a stationary position.

The joining apparatus is then activated to move across the edge of the drapery material which is to undergo the crinoline-bonding step.

A feed roll dispenses a crinoline strip and, simultaneously, a second feed roll dispenses an adhesive tape which is interfed between the said crinoline and said drapery material. A preheater directs warm air over the tape immediately prior to its emplacement upon the material, whereupon, a heat wheel follows to apply heat and pressure to the combined layers of drapery, tape and crinoline and liquify the adhesive so that it joins the crinoline and the material in a permanent bond.

In addition to preheating the crinoline, the material which is to be sealed is also preheated by means of strip heaters attached to a heating bar.

A cutter and cutter guide follow the heat wheel in a slotted track where the former cuts off the excess of joined material and crinoline to provide a proper finish.

Specifically, the apparatus of this invention comprises:

a. a support which consists essentially of the following elements:

1. a flat surface upon which the drapery material is lain;
2. a heating bar which warms that portion of the material which is to undergo the bonding operation; and
3. clamping devices at opposite ends of said table for the purpose of maintaining the material in a stationary position;

b. a machine which consists essentially of the following elements:

1. a first feed roll for continuously dispensing crinoline along that border of the material which is to undergo the bonding operation;
2. a second feed roll for continuously interfeeding a dry adhesive filament between said crinoline and said material;
3. a heat wheel which follows behind and along the strip of crinoline where it applies heat and pressure sufficient to liquify the adhesive so as to join the crinoline and drapery material;
4. a preheater which precedes the heat wheel and which blows warm air over the surface of the crinoline prior to its contact with the adhesive;
5. a cutter means which follows the heat wheel in a slotted track where it cuts off the excess of the joined material and crinoline;
6. a cutter guide which follows the cutter means in the slotted track and which thus serves to maintain the latter in a stable and effective cutting position; and c. conveyor means for moving the machine (b) across support (a) by propelling it along an overhead track.

BRIEF DESCRIPTION OF THE DRAWINGS

This invention, its apparatus and method of use, will be apparent from a description of the accompanying drawings.

Figure 1:
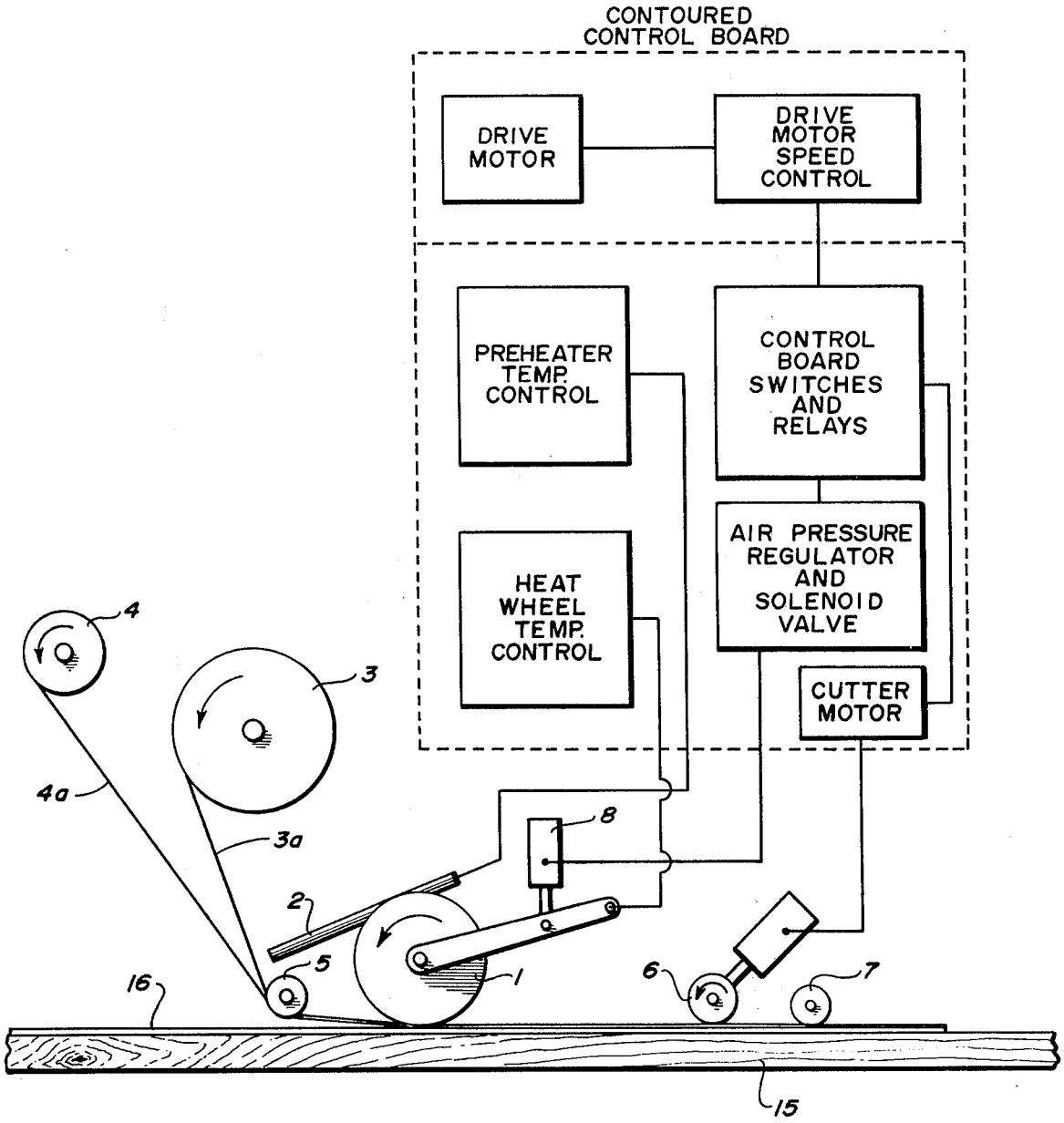
FIG. 1 is a schematic view of the apparatus comprising this invention.

DETAILED DESCRIPTION:

The novel method and apparatus of this invention is best understood by reference to the schematic of FIG. 1.

Drapery material 16 (hereinafter "material") is lain on support 15 where it is secured by clamping devices (not shown).

Crinoline 3*a* in the form of a filament is fed from feed roll 3 so that its outer edge lies parallel to and abuts the edge of material 16. At the same time a dry thermally active monofilament adhesive 4*a* is interfed from feed roll 4 so that it lies between material 16 and crinoline 3*a*. A guide means 5 directs the superimposed crinoline 3*a* and adhesive 4*a* onto the material 16.

Figure 3:
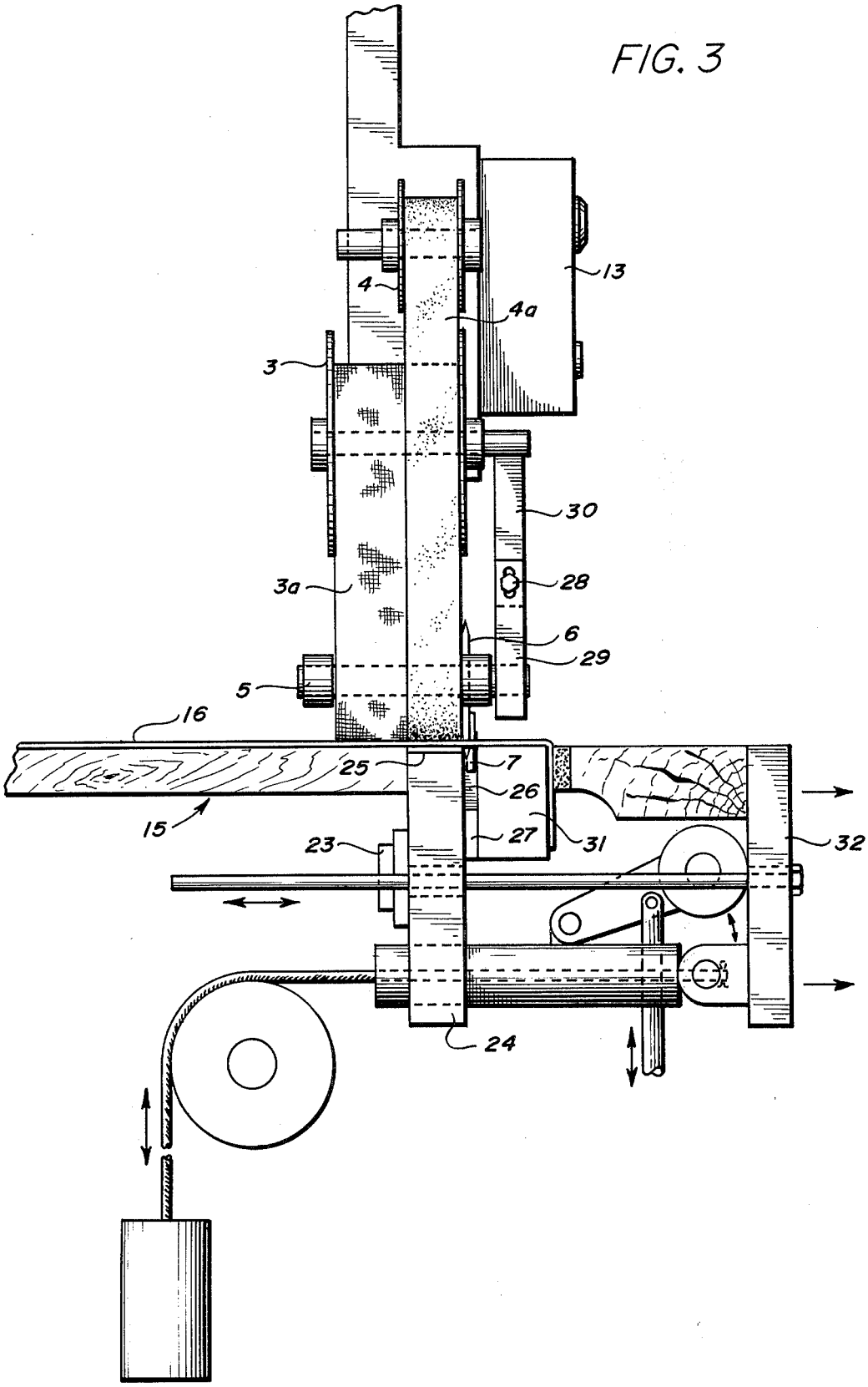
FIG. 3 is a partial side-view of the apparatus of FIG. 2.

The adhesive feed roll 4 and crinoline feed roll 3 are aligned to dispense the adhesive 4*a* and crinoline 3*a* in such manner that their outer edges are directly above one another (FIG. 3). Thus, the outer edge of the crinoline lies directly above the outer edge of the adhesive so that upon contact with the material there is a shared common outer edge as between crinoline 3*a*, adhesive 4*a* and material 16.

As the crinoline 3*a* and adhesive 4*a* come off their respective feed rolls a preheater 2 blows hot air across the surface of said crinoline. The temperature of the air which is emitted from this device is regulated by a thermostat described in FIG. 1 as a Preheater Temperature Control unit. The exiting air temperature is generally in the range of from about 800°–1,000° F. but we prefer to employ a temperature of about 850° F.

This preheating stage warms the crinoline 3*a* immediately prior to its initial contact with the adhesive 4*a* at guide means 5. As a result of this initial contact at the guide means there is a partial coalescence between crinoline 3*a* and adhesive 4*a* prior to their combined contact with material 16. This preheating feature distinguishes the invention from other known methods and offers the advantage of a faster sealing operation and a more effective and secure bond than was heretofore possible. Although applicants do not fully understand the reason for this improved result, it is believed due to a thoroughly warmed criinoline 3*a* which, because it has been preheated, combines readily with the adhesive 4*a* and with the material 16 to afford a wholly integrated bond. This cohesiveness is facilitated by the guide means 5 which brings the adhesive filament 4*a* and crinoline 3*a* into an initial contact prior to their being subjected to the effect of the heat wheel 1.

When the adhesive filament 4*a* and crinoline 3*a* leave the guide means 5 they are immediately compressed by heat wheel 1 which applies both pressure and heat to the superimposed combination of crinoline 3*a*, adhesive 4*a* and material 16. This operation causes the adhesive to melt completely whereupon it flows freely and spreads to provide a bond between material 16 and crinoline 3*a*. The temperature of the heat wheel is regulated by a thermostat identified in FIG. 1 as a Heat Wheel Temperature Control unit. The heat wheel 1 is raised prior to start-up and lowered into operational position by a heat wheel-lift-switch located on the Control Board. This operation is accomplished by the use of an air cylinder 8 and Air Pressure Regulator utilizing an extraneous air supply.

A sharply honed cut-off device 6 in the shape of a disc follows the heat wheel 1 in a slotted track where it trims off the excess of fabric. From the standpoint of this invention the material thus obtained is now in a finished condition; however, in practice, in the manufacture of draperies per se, the material is put into a salable form by folding the crinoline-backed fabric down desired guidelines and stapling or otherwise securing it in place. The resulting drapery is then removed from the support 15 and, in a continuous process, the foregoing operation is repeated to produce additional drapery material.

The machine of FIG. 1 moves over and above the surface of material 16. This movement is powered by a Drive Motor and it is propelled via a drive wheel on an overhead I beam track suspended above support 15. This movement of the coupling machinery across the face of the material to be joined is also a novel feature of this invention. It is known in the art, as described in the Heffernan and Bianchini patents, supra, that fabrics can be conveyed along moving belts to a coupling apparatus but the literature is silent in respect of tableing draperies which do not lend themselves to conveying means and which, therefore, must be maintained in a stationary position.

Figure 2:
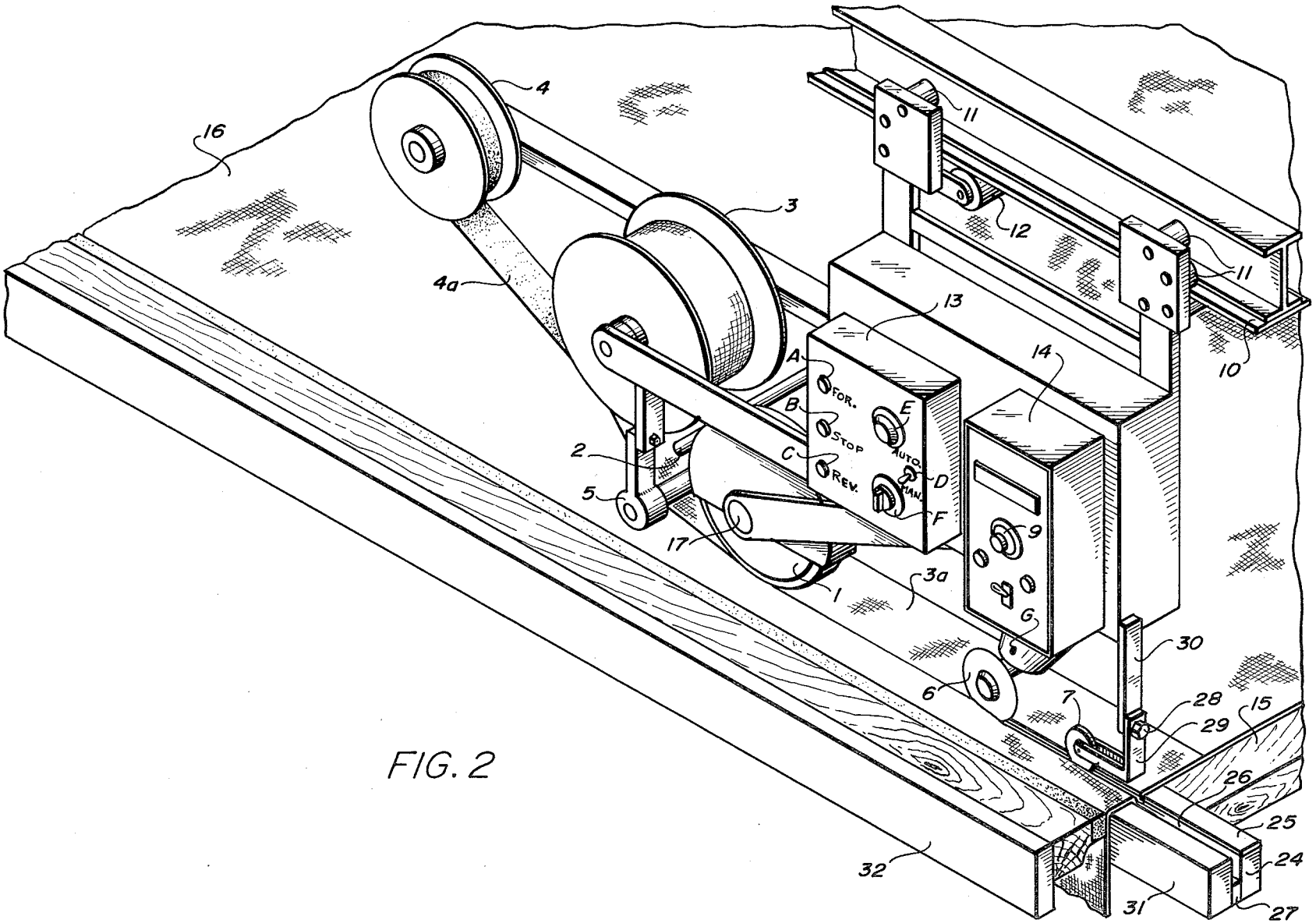
FIG. 2 is a front view of one embodiment of the apparatus.

FIG. 2 is a front view of the apparatus of this invention. In addition to depicting the machine per se and its conveying means, it also illustrates the support 15 for drapery material 16 and clamping device 32 which is used to secure said material to the support. When put into operation, the said machine moves over and above the secured material to perform the sealing step.

The operations of this machine are centrally controlled through panel 13 via pushbuttons A, B and C and toggle switch D.

In practice, the machine is made operational by first actuating the switches which control heat wheel 1 and heating bar 24 so that their temperatures can be normalized prior to the sealing step.

The heat wheel 1 is then activated by placing toggle switch D in the "Auto" position. As a result of this maneuver the control of heat wheel 1 is relayed to "Forward" button A where it is synchronized to go into operational position at the same time as the machine begins to move forward. Thus, upon depressing button A, the following steps occur simultaneously:

1. the machine is put into a drive mode and begins to move forward;
2. the heat wheel is automatically lowered into operational position, i.e., it comes into contact with the crinoline-backed material;
3. the preheater 2 is actuated; and
4. the cutter motor is turned on.

The pressure exerted upon the crinoline 3*a* and material 16 by heat wheel 1 is controlled via an air pressure regulator (not shown). As the machine moves over track 10 via rollers 11, its forward motion and the pressure exerted by the heat wheel upon the crinoline and adhesive filament serves to pull said crinoline and said filament off their respective rolls. Thus, as the machine moves along track 10, the crinoline 3*a* automatically is dispensed while, at the same time, the adhesive filament 4*a* is interfed off roll 4.

The machine can be made to go backwards by depressing Reverse button C or it can be brought to a halt by depressing Stop button B. Also, if it becomes necessary to interrupt the sealing operation or terminate it at any point along the bonding path, this can be accomplished by simply depressing Stop button B and placing toggle switch D in the Manual position. Thereupon, the heat wheel 1 can be physically raised off the crinoline to avoid scorching or permit removal of the crinoline-backed material.

The speed at which the machine travels over the crinoline surface is controlled via knob 9 on panel 14. In general, at heat wheel temperatures from about 300°–500° F. we have found it desirable to move the machine across the crinoline surface at a rate of approximately 12 feet per minute.

The temperature of the air emitted from preheater 2 is controlled by rotating knob E on panel 13 and the heat wheel temperature is controlled by knob F.

The preheater 2 blows warm air across the face of the crinoline 3*a* at a point immediately prior to its coming into contact with the adhesive filament 4*a*. The preheated crinoline 3*a* and adhesive filament 4*a* are then brought into initial contact by virtue of guide means 5. Thereafter, the bonding of the preheated material 16 to the crinoline 3*a* is accomplished by the contact of heat wheel 1 which melts the adhesive completely and applies a constant compressive pressure upon the superimposed combination of crinoline 3*a*, adhesive 4*a* and material 16. The adhesive filament employed in this operation has a melting point of about 275° C. and, therefore, it is essential that the heat wheel 1 be maintained at a suitably high temperature so as to effect a complete melt of the filament 4*a*. Suitable heat wheel temperatures include, for example, a range of from about 300° –500°F., preferably, 400° F.

The preheater 2 consists essentially of a stainless steel tube through which compressed air is blown over heating coils. The heating coils are wound around a ceramic or quartz core in a serpentine effect and have a capacity of from about 1,000 to 3,000 watts; however, in practice, we have found a 2,000 watt coil to be most suitable for the preheating of the adhesive filament 4*a*. The ceramic or quartz core measures about 8 inches in length and about ½ to ¾ inches in diameter but it is to be understood that other glass tubing of various dimensions could be substituted therefor with equally good results.

As indicated above, the air temperature emanating from preheater 2 is in the range of from about 800°–1,000° F.; however, we prefer to use an emission temperature of about 850° F. At emission temperatures of about 850° F. the area at or near the surface of the crinoline will generally be about 600° F.

FIG. 3 is a partial side view of the apparatus illustrating the relative positions of dispenser rolls 3 and 4 with respect to the material 16.

In FIG. 3 roll 3 and roll 4 are aligned to dispense crinoline 3*a* and adhesive 4*a* so that the outer edges thereof are in an essentially parallel relationship. As a result, the crinoline 3*a* and adhesive 4*a* come into initial contact with one another at guide means 5 sharing a common outer edge. Thereafter, the compression exerted by heat wheel 1 (not shown) serves to bring the combined crinoline 3*a* and adhesive 4*a* into intimate contact with material 16.

This preheating step is accomplished via the contact of material 16 with heating bar 24 which is integrally connected to support 15 and forms a part thereof. This heating bar serves as the operating edge for support 15 and pre-warms the material 16 along the entire bonding path. The temperature of heating bar 24 is effected and maintained via the attachment thereto of several strip heaters 23 which are appropriately spaced along its entire effective length. In this manner, the temperature of heating bar 24 can be maintained within a temperature range of from about 125°–175° F.; however, in practice, we prefer to maintain the heating bar at a temperature of about 150° F.

In FIG. 3 a*Teflon$^R$ tape 25 is adhesively secured to the surface of heating bar 24 along its entire length. This tape facilitates the bonding step by providing a resilient and heat resistant surface which, because of its non-stick properties, makes it possible to remove the bonded material with ease once the operation is completed.

*Teflon$^R$: a plastic tetrafluoroethylene homopolymer, is a trademark of E.I. DuPont deNemours and Company, Inc. Wilmington, Del. 19898

FIG. 3 also illustrates the position of cutter 6 and cutter guide 7 relative to support 15. The cutter guide follows the cutter in a slotted track 26 measuring about 1/16 inch in width. The purpose of guide 26 is twofold: it assures a straight-edge cut of material 16 and crinoline 3*a* by maintaining the apparatus along the path of track 26 and, secondly, it protects the cutter blade from damage or unnecessary wear by absorbing any side thrust or lateral movement. The cutter guide 7 may be adjusted for height by virtue of adjustment bolt 28 which is secured to the cutter arm 29 and moves in the slot of brace 30.

The clamping device 32 (FIG. 3) secures the overhanging drapering material 16 in position during the bonding operation. Thereafter, the cutter 6 which moves in slotted track 26 sheers the combined material and crinoline to provide a drapery which shares a common edge with its crinoline backing. As a result of this joinder of crinoline at the very edge of the drapery material an overcasting effect is afforded which prevents the unravelling of the material. This effect is particularly advantageous where a loose weave material is employed since such fabrics have a tendency to unravel to a greater degree than do their more closely woven counterparts.

Bar 31 and heating bar 24 may be comprised of any suitable metal but, in practice, we have found it desirable to use cold rolled steel for both items. In general, bar 31 measures approximately 1 inch by ⅜ of an inch and heating bar 24 measures approximately 2 inches by ⅜ of an inch. The spacer 27 is comprised of 1/16 by ½ inch steel and these components are bolted together.

Figure 4:
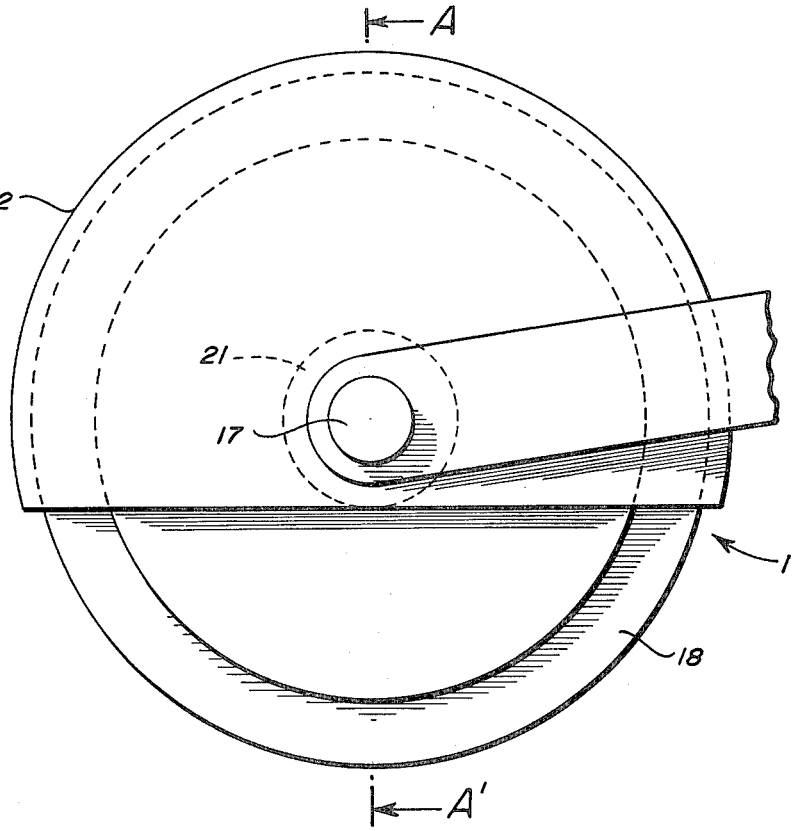
FIG. 4 is a front-view of the heat wheel employed with the apparatus.
Figure 5:
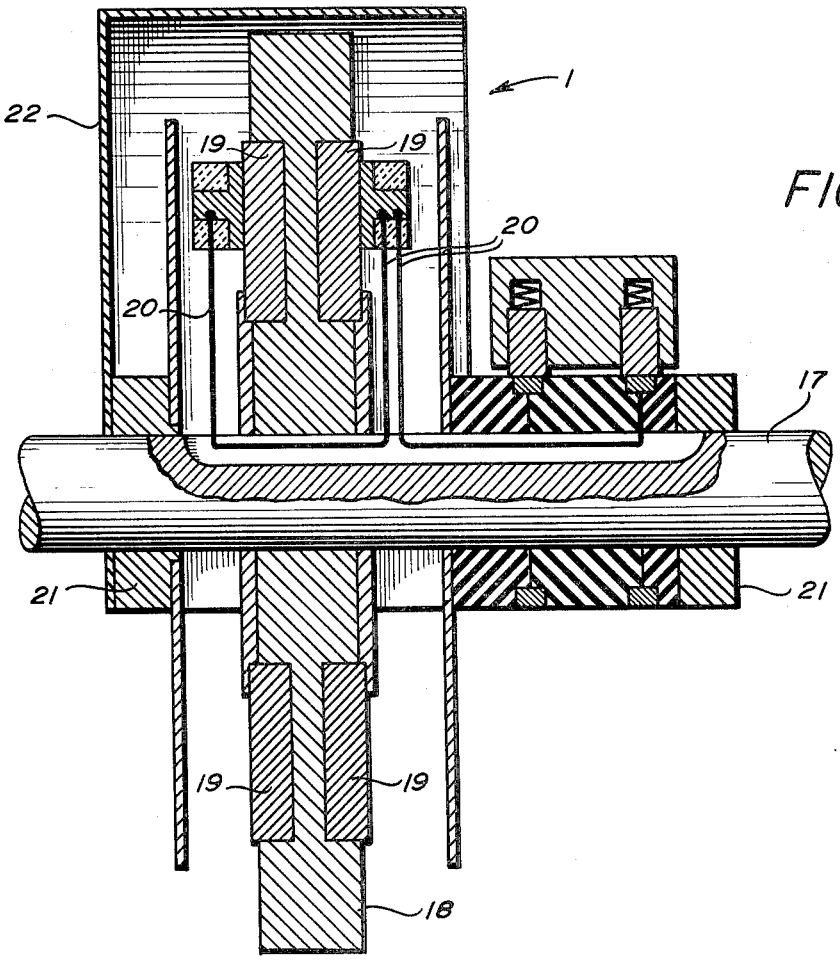
FIG. 5 is a cross-sectional side-view of the heat wheel shown in FIG. 4 along plane A—A[1].

FIGS. 4 and 5 illustrate the construction of heat wheel 1. This element consists largely of a metal disc 18 mounted on shaft 17 which revolves in bearings located at the ends of said shaft. This disc may be composed of any suitable metal such as steel or a steel alloy but, in practice, we have found it desirable to employ solid aluminum. A collar 21 on each end of shaft 17 maintains the said disc in operating position.

Set into the metal disc 18 are two ring heat elements 19 each having a rating of about 240 volts and 1,000 watts. These rings are conventional items composed essentially of steel, asbestos and a nichrome wire commonly used in heater elements. They are electrically connected for heating purposes via wires 20 wrapped with high temperature asbestos insulation. The operating mechanism of the heat wheel is protected by a shield 22.

A pyrometer equipped with a wiper-type thermocouple senses the heat of the wheel 1 and thus makes it possible to control its temperature within a 30° range.

The heat wheel 1 is equipped with an air cylinder 8 which makes it possible to raise and lower it by a solenoid value connected to Forward pushbutton A. Alternatively, it can be lifted manually by placing toggle switch D in the "Manual"position.

The cutter 6 is self-powered through an independent motor which is synchronized to operate with the Drive Motor via Forward switch A through relays; however, it can also be operated independent of the Drive Motor by depressing button G on the cutter housing.

It will be apparent to those skilled in the art that the temperatures employed in this process and the rate of operation are controllable conditions. They depend largely upon the materials employed as, for example, upon their ability to withstand scorching and upon the melting point of the adhesive filament. Therefore, to optimize results, it will sometimes be necessary or desirable to adjust operating conditions so as to make allowances for the various type of materials used in the process. Such variations are within the skill of the artisan and, therefore, they are considered as being within the scope of this invention.

Also, it should be understood that our concept is not limited by the foregoing description. Instead, it is capable of wide variation and modification and to the extent that any such modification is obvious we expressly include it as being within the scope of this invention.

Having described our concept and its preferred embodiments, we present the following claims.

What is claimed is:

1. Apparatus for tableing draperies which comprises:

a. a support consisting essentially of the following:
   1. a flat surface upon which the drapery material is lain;
   2. a heating bar, integrally connected to the flat surface and serving as its operating edge, for the purpose of preheating that portion of the drapery material which is to undergo the bonding operation; and
   3. clamping devices for maintaining the material in a stationary position;

b. a machine which consists essentially of the following elements:
   1. a first feed roll for continuously dispensing crinoline along that border of the material which is to undergo the bounding operation;
   2. a second feed roll for continuously interfeeding a dry adhesive filament between said crinoline and said material;
   3. a heat wheel which follows behind and along the strip of crinoline where it applies heat and pressure sufficient to liquify the adhesive so as to join the crinoline and drapery material;
   4. a preheater which precedes the heat wheel and which blows warm air over the surface of the crinoline prior to its contact with the adhesive;
   5. a cutter means which follows the heat wheel in a slotted track where it cuts off the excess of the joined material and crinoline; and
   6. a cutter guide which follows the cutter means in said slotted track; and c. a conveyor means for moving the machine (b) across support (a) by propelling it along an overhead track.

2. The apparatus of claim 1 wherein the machine(b) which moves across support(a) is propelled via rollers on an overhead track.

3. The apparatus of claim 1 wherein the heating bar is maintained at a temperature of from about 125°–175° F.

4. The apparatus of claim 1 wherein the temperature of the air exiting from the preheater is in the range of from about 800°–1000° F.

5. The apparatus of claim 1 wherein the temperature of the heat wheel is in the range of from about 300°–500° F.

6. The apparatus of claim 1 wherein the adhesive filament and crinoline are brought into initial contact via a guide means prior to their combined contact with the material.

7. The apparatus of claim 1 wherein the first and second feed rolls are aligned to dispense crinoline and adhesive, respectively, so that said crinoline and said adhesive share a common outer edge with the drapery material.

8. The apparatus of claim 1 wherein the heating bar which serves as the operating edge for the sealing step is maintained at a temperature of from about 125°–175° F by the attachment thereto of several strip heaters appropriately spaced along its entire effective length.

9. The apparatus of claim 8 wherein the temperature of the heating bar is maintained at a temperature of about 150° F.

10. The apparatus of claim 8 wherein the heating bar has secured to its surface a Teflon tape to provide a base for the sealing operation.

11. A method of bonding crinoline to draperies which consists essentially of laying drapery material face down on a support comprising:

1. a flat surface;
2. a heating bar, integrally connected to the flat surface and serving as its operating edge, for the purpose of preheating that portion of the drapery material which is to undergo the bonding operation; and
3. clamping devices for maintaining the material in a stationary position; and activating a joining machine to move across the edge of the material which is to undergo the crinoline-bonding step; wherein the machine consists essentially of the following elements:

1. a first feed roll for continuously dispensing crinoline along that border of the material which is to undergo the bonding operation;
2. a second feed roll for continuously interfeeding a dry adhesive filament between said crinoline and said material;
3. a heat wheel which follows behind and along the strip of crinoline where it applies heat and pressure sufficient to liquify the adhesive so as to join the crinoline and drapery material;
4. a preheater which precedes the heat wheel and which blows warm air over the surface of the crinoline prior to its contact with the adhesive;
5. a cutter means which follows the heat wheel in a slotted track where it cuts off the excess of the joined material and crinoline; and
6. a cutter guide which follows the cutter means in said slotted track.

* * * * *